US005520837A

United States Patent [19]

Antin et al.

[11] Patent Number: 5,520,837

[45] Date of Patent: May 28, 1996

[54] METHOD OF MAKING AN ENVIRONMENTALLY SAFE, READY-TO-USE, NON-TOXIC, NON-FLAMMABLE, INORGANIC, AQUEOUS CLEANING COMPOSITION

[75] Inventors: Neil E. Antin, Germantown, Md.; Douglas P. Jackson, Rockaway, N.J.

[73] Assignee: The United States of America as represented by the Secretary of the Navy, Washington, D.C.

[21] Appl. No.: 495,877

[22] Filed: Jun. 28, 1995

Related U.S. Application Data

[63] Continuation-in-part of Ser. No. 181,504, Jan. 14, 1994, Pat. No. 5,427,709.

[51] Int. Cl.[6] ..... C11D 7/14; C11D 7/60; C11D 7/10

[52] U.S. Cl. ..... 252/135; 252/174.25; 252/389.3; 252/389.4; 252/389.54; 252/181; 252/387; 134/42; 423/279; 423/280

[58] Field of Search ..... 252/174.25, 389.3, 252/389.4, 389.54, 135, 181, 387; 134/42; 423/279, 280

[56] References Cited

U.S. PATENT DOCUMENTS

| | | | |
|---|---|---|---|
| 4,097,287 | 6/1978 | Ito et al. | 106/14.14 |
| 4,105,511 | 8/1978 | Nikaido et al. | 204/38 A |
| 5,118,434 | 6/1992 | Meyer et al. | 252/70 |

*Primary Examiner*—Paul Lieberman
*Assistant Examiner*—Wyatt B. Pratt
*Attorney, Agent, or Firm*—Edward J. Connors, Jr.; William C. Townsend; Kenneth Dobyns

[57] ABSTRACT

A cleaning composition, method of manufacture and method of cleaning of for use in cleaning equipment including life support equipment employed in the generating, handling, storage and delivery of oxygen-enriched gases and liquids are provided in which the cleaning composition is inorganic, non-flammable, non-toxic, environmentally safe, non-corrosive, and ready to use and which includes an aqueous silicate solution together with fluoroborates and molybdates.

3 Claims, No Drawings

METHOD OF MAKING AN ENVIRONMENTALLY SAFE, READY-TO-USE, NON-TOXIC, NON-FLAMMABLE, INORGANIC, AQUEOUS CLEANING COMPOSITION

This application is a continuation-in-part of U.S. application Ser. No. 08/181,504 filed Jan. 14, 1994 which is U.S. Pat. No. 5,427,709.

BACKGROUND OF THE INVENTION

This invention relates to cleaning compositions and more particularly to a method of making those compositions, hereinafter referred to as oxygen cleaning agents, which are employed in cleaning the surfaces of oxygen or oxygen-enriched liquid and gas generating, handling, transport and storage equipment used for life support, propulsion, and other functions and the parts and assemblies thereof, such as hoses, pipes, valves, tanks, flasks, connectors, pumps, regulators, face masks and the like.

The standards of the Department of Defense (DOD), National Aeronautical and Space Administration (NASA), National Fire Protection Agency (NFPA), American Society of Testing and Materials (ASTM) and Society of Automotive Engineers (SAE) all specify that the rigorous removal of organic and particulate contamination from oxygen and oxygen enriched handling equipment is absolutely necessary to prevent a fire hazard. Failure to thoroughly clean oxygen and oxygen enriched handling equipment will and has resulted in catastrophic fires. The DOD, NASA, NFPA, ASTM and SAE all have records of equipment damage and personnel injuries and death from fires caused by the failure to adequately clean oxygen and oxygen enriched handling equipment. Testing by NASA has demonstrated that, in the presence of an ignition source caused by the presence of particulate contamination or organic material, many metals will burn in an oxygen atmosphere; and that the rate of burning will be extremely fast. For example, ASTM document G94-88, "Standard Guide for Evaluating Metals for Oxygen Service" reports 6061 aluminum in 100% oxygen at 276 bars burned at an average propagation rate of 13.86 centimeters per second and 316 stainless steel in 100% oxygen at 276 bars burned at an average propagation rate of 1.24 centimeters per second. NASA has high-speed video footage of a 690 bars rated valve operating with 276 bars gaseous oxygen as it fails due to particulate contamination. The conflagration penetrated and expanded beyond a 7.62-centimeter-thick stainless steel valve in 0.25 seconds. Accompanying the fire hazard is a toxicity hazard associated with oxygen and oxygen-enriched handling equipment used in providing life support functions. The organizations previously referred to all have reports of personnel injury and death from toxic residue remaining in life-support equipment that was cleaned with a cleaning agent which was inadequate, either because it failed to remove toxic contaminants or because it contained toxic contaminants itself. As an example, the use of chlorinated hydrocarbon solvents is prohibited in underwater diving life support equipment because these compounds release chlorine in carbon dioxide scrubbers, forming highly toxic and flammable dichloroacetylene.

The requirements for oxygen cleaning agents include the capability of removing common hydrocarbon soils such as lubricating oils and greases, since the presence of these soils represents an extreme fire hazard. Further, oxygen cleaning agents must be capable of removing particulate contamination, since the presence of excessive particulate contamination provides a potential ignition source in oxygen and oxygen-enriched handling equipment. Further, oxygen cleaning agents must be capable of removing halogenated lubricants approved for use with oxygen storage and delivery equipment. Although halogenated lubricants are used in oxygen-enriched handling equipment because they are not flammable, the failure to remove these lubricants during cleaning provides a mechanism for trapping particulate and/or hydrocarbon contamination. Further, the oxygen cleaning agent itself must be non-flammable in a gaseous or liquid oxygen environment so as not to present a fire hazard in the event the cleaner is not completely removed. Further, the oxygen cleaning agent itself must be either non-toxic or of an acceptable low level of toxicity as determined by a medical evaluation (such as trichlorotrifluoroethane solvent (also identified as CFC-113)) in the event the cleaner is not completely removed during the cleaning process. Further, the oxygen cleaning agent must be capable of being analyzed for residual total hydrocarbon contamination with a sensitivity of at least 1 part per million (ppm) to permit accurate, certifiable verification of hydrocarbon cleanliness. Finally, Department of Defense (DOD), National Aeronautical and Space Administration (NASA), and various commercial standards require oxygen-enriched handling equipment to be certified hydrocarbon clean. The DOD standard (MIL-STD-1330C) certifies hydrocarbon cleanliness when the effluent cleaning agent, that is, the cleaning agent following its use in cleaning the oxygen enriched handling equipment, measures less than 5 ppm total hydrocarbon contamination. A conversion factor is applied to convert the DOD standard to the NASA hydrocarbon cleanliness standard of 1 milligram per square foot.

The two principal existing oxygen cleaning agents are trichlorotrifluoroethane solvent (also identified as CFC-113) and tribasic sodium phosphate solution (also identified as TSP). CFC-113 is an ozone depleting substance, and a replacement will become necessary because its production is banned after Dec. 31, 1995. TSP has the disadvantage that it is a hazardous environmental waste. Further, TSP is corrosive to amphoteric metals such as aluminum. Further, TSP is of marginal effectiveness in removing the halogenated lubricants which can trap particulate and hydrocarbon contaminants. Further, TSP must be applied at relatively high temperatures in the range of 71.1° C. to 87.8° C. Further, at temperatures below the above-noted range, TSP precipitates leaving harmful deposits. Further, TSP leaves a phosphate conversion coating on the surface being cleaned which may deleteriously affect the finish (smoothness) of that surface even after rinsing with water. Finally, the use of TSP as a cleaner requires extensive rinsing to prevent the formation of hard phosphate residues which are not readily soluble in water and which are detrimental to critical components.

In addition, there are numerous aqueous or solvent based biodegradable cleaners available which claim to have oxygen system cleaning capabilities. However, these cleaners contain hydrocarbon derivative components (such as organic surfactants) and thus have the disadvantages associated with hydrocarbons previously noted. Specifically, they have the fire hazard associated therewith, a potential toxicity hazard in life-support systems and an inability to analyze the effluent cleaning agent for residual total hydrocarbon contamination with a sensitivity of at least 1 part per million (ppm) to permit accurate, certifiable verification of hydrocarbon cleanliness. Finally, alternate chlorinated solvents such as perchloroethylene and methylene chloride are unusable in any life-support equipment because these solvents are highly toxic, having been identified as suspected human carcinogens.

As disclosed in U.S. Pat. No. 5,427,709 issued on Jun. 27, 1995, to the assignees of the present application (hereinafter the '709 patent), the preferred oxygen cleaning agent made according to the invention disclosed and claimed in the '709 patent is an aqueous inorganic solution comprising silicon dioxide ($SiO_2$) and an inorganic oxide compound ($X_2O$) at a $SiO_2$:$X_2O$ mole ratio in the range of 1.8 to 2.2 with a polysilicate anion concentration in the range of 2 to 18% by weight; an inorganic fluoroborate compound ($XBF_4$) in the range of 0.01 to 1.0% by weight; an inorganic molybdate compound ($X_2MoO_4$) in the range of 0.01 to 1.0% by weight and the balance by weight demineralized water wherein X is a member of the group consisting of sodium and potassium. The pH of the final aqueous solution is 11.5 to 12.0. The purity of each constituent previously described must be such that the final cleaner composition meets the following requirements: the visual clarity shall be clear with no visible contamination, the total carbon contamination (including hydrocarbons minus any carbon present as carbon dioxide) shall not exceed 1.0 ppm, the total insoluble matter shall not exceed 0.5 ppm, and the total chloride contamination shall not exceed 2.0 ppm. The preferred elements, ranges and pH for optimum performance are as follows: a $SiO_2$:$X_2O$ mole ratio in the range of 1.8 to 1.9; a polysilicate anion concentration in the range of 9.0 to 10% by weight; an inorganic fluoroborate compound ($XBF_4$) in the range of 0.4 to 0.6% by weight; an inorganic molybdate compound ($X_2MoO_4$) in the range of 0.4 to 0.6% by weight and the pH of the final aqueous solution in the range of 11.9 to 12.0; where X is either sodium or potassium.

In an alternate form of the cleaning agent, the resulting cleaning agent can also be supplied with organic surface wetting agents (surfactants) such as the fluorosurfactants "Zonyl", manufactured by Dupont Company, to enhance the removal of thick soil deposits. However, this form of the cleaning agent will not be acceptable for final cleaning of oxygen enriched handling equipment for the reasons previously noted. Specifically, the presence of organic surfactants has an associated potential fire and toxicity hazard and results in inability to analyze the effluent cleaning agent for residual total hydrocarbon contamination with a sensitivity of at least 1 part per million (ppm) to permit accurate, certifiable verification of hydrocarbon cleanliness.

It should be noted that the X component referred to previously could be chosen from a group also including: ammonium, barium, beryllium, calcium, cesium, lithium, magnesium, rubidium and strontium. However, while the compound resulting from such additional possibilities would be inorganic and might have acceptable cleaning performance, the resulting toxicity, reduction of corrosion inhibition, and difficulty in rinsing would severely limit the use of the cleaner, making it impractical in practice.

This invention relates to the manufacture of an aqueous inorganic cleaning agent comprising a silicate solution of $SiO_2$ and $X_2O$ in a $SiO_2$:$X_2O$ mole ratio in the range of 1.8 to 2.2 with a polysilicate anion concentration in the range of 2 to 18% by weight, a corrosion inhibitor material selected from the group consisting of $XBF_4$ with a weight concentration in the range of 0.01 to 1.0% and $X_2MoO_4$ with a weight concentration in the range of 0.01 to 1.0% and mixtures thereof and the balance demineralized water wherein X is chosen from the group consisting of sodium and potassium.

The prior art defines many uses of silicates for heat silicates are commonly added for corrosion resistance, alkalinity and dispersive functions. The prior art also defines the manufacture of the various silicated end products. However, common among these are the always present organic (defined for the purposes herein as any C—H bonded material) additives. Further, when presented as an aqueous solution, rarely is the silicate concentration greater than 2%. Further, acids are rarely if ever added to silicate solutions because of their propensity to form gels and sols rendering any solution useless. Further, it is common chemical mixing practice to dilute concentrated bases or acids by adding them to water, thus preventing any deleterious exothermic/thermodynamic reaction. Further, common practice limits extensive mixing because of the inherent foaming characteristic of the organic additives.

The prior art of manufacturing aqueous based silicated fluids using low silicate concentrations, organic additives, no acids, and little mixing is not applicable for the aqueous inorganic precision cleaning agent of this invention comprising silicates, molybdates, and fluoroborates.

Wilhelm Eitel, in Silicate Science, Academic Press, (1964) discusses at length the stability of aqueous silicate solutions as a function of pH. Specifically, as pH drops below 11.0, silicate polymerization occurs leading to high molecular weight silicate compounds that will eventually exceed the solubility of the parent solution. This results in silicates precipitating out of solution generating the commonly known silicate gels and sols. The dissolution is not thermodynamically reversible. Eitel further indicates that the rate of polymerization is a maximum between a pH of 8.0 and 9.0. A particular concern is that silicate solutions intended for the manufacture of precision cleaning agents are generally supplied as a concentrate. Common practice would dilute the concentrate by adding it to water. However, this has the effect of causing the concentrated silicate solution to undergo a pH transition from 7, that of the base demineralized water, up to 12 as the solution reaches the desired silicate concentration. This cycles the silicate between polymerization and depolymerization, with the hope that the later will be 100%. However, experience indicates that for high concentrations of silicates (defined for the purposes herein of greater than 2%), depolymerization is not complete. Previously polymerized material remains, leading to subsequent dissolution characterized as a white flocculent or precipitate in an otherwise clear solution. The polymerization is accelerated at the higher temperatures common to the application temperatures of alkaline cleaning agents. The primary cause of this increased polymerization is the inverse pH-temperature relationship noted in the cleaning composition. Between 25° C. and 75° C., the pH of the cleaning composition drops by 0.75 pH units. Thus, cleaning agent that appears clear and stable at room temperature can become unstable in a few hours when heated to the application temperature leading to complete dissolution.

The instability of silicate solutions is addressed in the prior art as is evident in Meyer et al U.S. Pat. No. 5,118,434, Dubin U.S. Pat. No. 4,532,047, and Mohr et al U.S. Pat. No. 4,772,408. However, three factors have mitigated the instability. First and foremost, existing silicated products contain organic additives. Review of the many applicable Military Specification formulas, as well as formulas in W. G. Cutler and R. C. Davis, *Detergency Theory and Test Methods, Marcel Dekker, Inc.* (1972), all include organic additives. These organic additives function to prevent aggregation of the large molecular weight silicates that may have polymerized thereby preventing dissolution. However, while the appearance is that of a stable silicate solution, the molecular structure of the silicate has changed rendering its function as a cleaning agent essentially useless. Second, the silicated fluids rarely exceed 2% and when they do, the pH is always very high at 12.5 or above. Higher pH presents a more soluble environment for the silicates. However, pH greater than 12.0 is severely corrosive to amphoteric metals such as aluminum, and presents difficult and costly environmental disposal issues. Third, the common use of silicates in prior art is for corrosion resistance, alkalinity and dispersive properties which can all be achieved using sodium metasilicates ($SiO_2$: $Na_2O$ mole ratio of 1.0) at low concentrations. Where higher concentrations are used, the high pH silicated solution, with organic additives, is provided with the intent of being diluted.

Prior art in text books and vendor literature discusses the limited solubility of acids with silicate solutions. The addition of strong acids to silicate solutions generally results in the immediate polymerization and/or precipitation of silicate material leading to the formation of silicate gels and sols. Hydrofluoric acid is one of the very few acids soluble with silicates. However, the hazardous properties of this acid preclude any significant use.

Dr. Manohar S. Grewal, "Switch to Aqueous Technology Gives Gillette Edge in Blade Manufacturing", *Precision Cleaning, April* 1995 discusses considerable variability in the performance of aqueous cleaners in the precision cleaning of razor blades. One of the inherent problems lie with how aqueous cleaners are manufactured. The common manufacturing method is to mix components in large drums or containers employing a large paddle wheel to obtain homogeneous mixing. Aggressive mixing with a centrifugal pump is generally excluded because of the potential for foam generation.

DETAILED DESCRIPTION OF THE PREFERRED EMBODIMENTS

The cleaning agent of this invention cleans oils, greases, fats, including halogenated oils and greases, and particulate matter from metallic, rubber and plastic surfaces when applied hot at temperatures of from 37.8° C. to 93.3° C. The cleaning agent can be used as a pumped pipe-line cleaner, batch tank cleaner, spray impingement cleaner, steam cleaner and ultrasonic tank cleaner. The cleaner, being an alkaline solution, will remove common organic fat based soils by emulsification or solubilization. The cleaner removes the more difficult industrial based hydrocarbons and halogenated mineral oil and mineral grease soils from a surface by displacement. The principle displacing agent is the polysilicate anion. At the $SiO_2$:$X_2O$ mole ratio in the range of 1.8 to 2.2, these polysilicate anions exist as charged cyclic silicate molecules. These structures include the more numerous $[Si_3O_9]^{n-}$ molecules and less numerous $[Si_4O_{12}]^{n-}$ molecules with charges of −6 and −8 respectively. At the 2 to 18% by weight polysilicate anion concentration, the charged cyclic silicate molecules develop electrostatic forces that displace and disperse the soil from the substrate while depositing an inorganic amorphous glass surface. The inorganic amorphous glass surface prevents redeposition of the soil and is easily hydrated and removed by rinsing with water. The electrostatic forces and subsequent displacement ability previously described are not inherent with the more commonly used orthosilicate and disilicate species because these molecules share all the oxygen resulting in no net electrical charge yielding a poor cleaner, but good alkaline builder.

EXAMPLE I: Soil removal performance of oxygen cleaning agent as described in EXAMPLE I was as follows: a MONEL (NiCu) metallic sample of dimensions 2.54 centimeter by 5.08 centimeter by 0.635 centimeter thick was coated with military specification MIL-L-17331 hydrocarbon mineral oil at a concentration of 15.5 milligrams per square centimeter and allowed to soak fully immersed in 100 milliliters of oxygen cleaning agent at 71.1° C. for 30 minutes with no agitation. The oxygen cleaning agent removed 95.9% of the oil; a MONEL (NiCu) metallic sample of dimensions 2.54 centimeter by 5.08 centimeter by 0.635 centimeter thick was coated with federal specification A-A-50433 hydrocarbon mineral grease at a concentration of 15.5 milligrams per square centimeter and allowed to soak fully immersed in 100 milliliters of oxygen cleaning agent at 71.1° C. for 30 minutes with no agitation. The oxygen cleaning agent removed 92.7% of the grease; a MONEL (NiCu) metallic sample of dimensions 2.54 centimeter by 5.08 centimeter by 0.635 centimeter thick was coated with military specification DOD-L-24574 Halocarbon Products HP4.2S halogenated oil at a concentration of 15.5 milligrams per square centimeter and allowed to soak fully immersed in 100 milliliters of oxygen cleaning agent at 71.1° C. for 30 minutes with no agitation. The oxygen cleaning agent removed 99.9% of the oil; a MONEL (NiCu) metallic coupon of dimensions 2.54 centimeter by 5.08 centimeter by 0.635 centimeter thick was coated with military specification MIL-G-47219 Halocarbon Products HP25-5S halogenated grease at a concentration of 15.5 milligrams per square centimeter and allowed to soak fully immersed in 100 milliliters of oxygen cleaning agent at 71.1° C. for 30 minutes with no agitation. The oxygen cleaning agent removed 100.0% of the grease.

Other advantages of the oxygen cleaning agent of this invention are described as follows: it is non-flammable; is non-toxic; contains no environmentally hazardous material; is compatible with non-metallic material; is easily rinsed leaving no residue; does not separate when subjected to freeze-thaw or boiling; does not produce a stable foam which would affect its use as a pump line or spray cleaner; and is capable of being analyzed by various techniques for residual total hydrocarbon contamination with a sensitivity of at least 1 part per million (ppm) to permit accurate, certifiable verification of hydrocarbon cleanliness. The analysis techniques include solvent extraction with subsequent infrared analysis, solvent extraction with subsequent gravimetric analysis of non-volatile residue, total carbon analysis of the cleaner directly, and ultraviolet analysis of the cleaner directly. These analysis techniques are possible because of the very low organic content (less than 1.0 ppm) and optical clarity (maximum insoluble matter of 0.5 ppm and filtered through 3 micron filters) of the cleaner of this invention in comparison to other cleaners. Silicate solutions with $SiO_2$:$X_2O$ mole ratios (wherein X is either sodium or potassium) of less than or equal to 2.0 do not show any evidence of aggregating into micron or sub-micron sized colloidal particles. Therefore, the turbidity (measure of reflected light) of the cleaning agent is very low in comparison to other cleaners. The resulting advantage is the ability to quickly and easily evaluate the presence of extremely low levels of organic and inorganic contaminates which will exist in the cleaner as colloidal particles by the change in reflected light. As the $SiO_2$:$X_2O$ mole ratio increases above 2.0, turbidity increases as some aggregation occurs, effecting the ability to detect extremely low levels of organic and inorganic contaminates. Finally, the cleaning agent exhibits excellent corrosion resistance on metallic materials. Although silicate solutions are reputed to have inherent corrosion resistance characteristics, testing with amphoteric metals indicated otherwise. Specifically, aluminum alloys 5052, 5456, and 6061, all of which are constituent metals of aviation oxygen systems, demonstrated rapid corrosive attack by silicate alkaline solutions. This is corrected by the addition of the inorganic and environmentally safe molybdate and fluoroborate compounds. The corrosion inhibiting characteristics of molybdate compounds and fluoroborate compounds combine to produce a synergistic corrosion inhibitor system greater than the sum of the individual molybdate and fluoroborate compounds.

EXAMPLE II: The aluminum corrosion resistance performance of the oxygen cleaning agent described in EXAMPLE I is as follows: three alloy 5052 aluminum coupons, each having a total surface area of 31 square centimeters were immersed for 24 hours in the oxygen cleaning agent at 76.7° C. The resultant weight loss was between 0.032 and 0.065 milligrams per square centimeter with no visual evidence of corrosion or staining; three alloy 5456 aluminum coupons, each having a total surface area of 38 square centimeters were immersed for 24 hours in the oxygen cleaning agent at 76.7° C. The resultant weight loss was between 0.053 and 0.105 milligrams per square centimeter with no visual evidence of corrosion or staining; and three alloy 6061 aluminum coupons, each having a total surface area of 41 square centimeters were immersed for 24 hours in the oxygen cleaning agent at 76.7° C. The resultant weight loss was 0.000 milligrams per square centimeter with no visual evidence of corrosion or staining.

The preferred method of manufacturing the inorganic aqueous cleaning composition of this invention is as follows: demineralized water is added to an aqueous silicate solution of $SiO_2$ and $X_2O$ in a $SiO_2$:$X_2O$ mole ratio in the range of 1.8 to 2.2 of known concentration that is maintained in motion (e.g. by paddle wheel, pump, or other method) to obtain a polysilicate anion concentration of 2 to 18% by weight, wherein X is a member of the group consisting of sodium and potassium. Reagent grade $X_2MoO_4$ is then added to obtain a weight concentration in the range of 0.01 to 1.0%, wherein X is a member of the group consisting of sodium and potassium. Reagent grade fluorboric acid ($HBF_4$) is diluted to within the range of from 1:1 to 20:1 with demineralized water and then added to the solution while in motion (by paddle wheel, pump or other method) at a rate no less than 3.8 liters per minute to obtain a pH of 11.5 to 12.0 and a weight concentration in the range of 0.01% to 1.0% of in-situ $XBF_4$, wherein X is a member of the group consisting of sodium and potassium.

A centrifugal pump, is then be used to ensure complete blending of the cleaning compound. The minimum blending time when recirculating cleaning compound through the pump is determined as follows:

Minimum blending time=(0.693/W)(V)(5)

where: W=pump flow rate in liters per minute and

V=batch volume in liters.

The novelty of the invention is the method in which the highly concentrated silicated cleaning solution is manufactured without the benefit of any organic additives and the method in which the pH is reduced without resulting in polymerization.

The first step of adding demineralized water to the concentrated silicate solution precludes the pH transition from 7, that of the base demineralized water, up to around 12.4 as the solution reaches the desired silicate concentration. This prevents cycling the silicate solution between polymerization and depolymerization. The addition of water to the concentrated silicate, results in a pH reduction from about 12.7 to 12.4. At no time is the silicate subjected to an unstable environment.

The second step of adding sodium or potassium molybdate allows the solution to reach maximum conductivity prior to the addition of the fluoroboric acid which will partially neutralize the solution causing a drop in both pH and conductivity.

The third step of adding diluted fluoroboric acid, partially neutralizes the solution with the following results: the pH is reduced from about 12.4 to 11.5 to 12.0 for better corrosion resistance and environmental compatibility while forming in-situ sodium or potassium fluoroborate for additional corrosion resistance. This is all accomplished without effecting the concentration of the polysilicate anion which would effect the performance of the cleaning composition. Additionally, this is accomplished with an acid that is both soluble (at the concentrations previously discussed) with the silicate solution and, in situ, is not an environmental hazard.

The fourth step of recirculating the solution through a centrifugal pump for the time specified provides a 97% probability that the solution is completely mixed to ensure meeting the compositional specifications previously stated. The minimum mixing time formula is a variation of a continuous concentration-dilution equation which defines the recirculation half-life (0.693/W)(V) or the time it takes for 50% of the solution to pass from a tank, through a centrifugal pump or equivalent mixer, and back to the tank. The factor 5 relates to five half-lives resulting in 97% of the solution being passed through the centrifugal pump or equivalent mixer and originates from the common equation $(1\frac{1}{2}^{n})(100\%)$. Factors of "n" greater than 5 are economically impractical. Factors of "n" less than 5 result in inadequate mixing.

EXAMPLE III: Cleaning composition according to the specifications previously stated was manufactured according to the invention as follows: 1,357 kilograms of demineralized water per ASTM D1193 Type II was added to 517.6 kilograms of a 40% (26% $SiO_2$/14% $Na_2O$) sodium silicate solution having a $SiO_2$:$Na_2O$ mole of 1.85. Then 10.4 kilograms 99.9% sodium molybdate was added to the solution. Then 30.9 kilograms of 48 to 50% fluoroboric acid diluted with 154.4 kilograms of demineralized water per ASTM D1193 Type II was added to the solution at a rate of 7.6 liter per minute. The entire solution was then recirculated through a 188 liter per minute centrifugal pump for 35 minutes. A sample of the final solution was subsequently heated to 75° C. After 168 hours, no evidence of precipitation, flocculent or other separation was noted.

EXAMPLE IV: Preparation of the oxygen cleaning agent would be the same as in EXAMPLE III except that potassium would be substituted for sodium.

EXAMPLE V: Cleaning composition according to the specifications previously stated was manufactured not according to the invention as follows: 517.6 kilograms of a 40% (26% $SiO_2$/14% $Na_2O$) sodium silicate solution having a $SiO_2$:$Na_2O$ mole of 1.85 was added to 1,511.4 kilograms of demineralized water per ASTM D1193 Type II. Then 10.4 kilograms 99.9% sodium molybdate was added to the solution. Then 30.9 kilograms of 48 to 50% fluoroboric acid was added batch wise to the solution. A sample of the final solution was subsequently subjected to 75° C. After 48 hours, complete silicate dissolution occurred. Thus failure to follow the inventive manufacturing method described resulted in a solution useless as a cleaner.

What is claimed is:

1. The method of manufacturing a cleaning composition comprising the steps of: adding demineralized water to an aqueous silicate solution of $SiO_2$ and $X_2O$ in a $SiO_2$:$X_2O$ mole ratio in the range of 1.8 to 2.2 to obtain a polysilicate anion concentration of 2 to 18% by weight, wherein X is a member of the group consisting of sodium and potassium; maintaining the solution in motion; adding reagent grade $X_2MoO_4$ to obtain a weight concentration in the range of 0.01 to 1.0%; adding reagent grade fluoroboric acid ($HBF_4$) to obtain a pH of 11.5 to 12.0 and a weight concentration in the range of 0.01% to 1.0% of in-situ $XBF_4$; and blending the solution with a blending means for a period of time sufficient to insure substantially complete blending of the components of the solution.

2. The method of claim 1 wherein the reagent grade fluoroboric acid ($HBF_4$) which has been diluted to within the range of from 1:1 to 20:1 with demineralized water at a rate no less than 3.8 liters per minute.

3. The method as set forth in claim 1 in which the blending means is a centrifugal pump, and the blending time when recirculating cleaning compound through the pump is determined as follows:

Minimum blending time=(0.693/W)(V)(5)

where: W=pump flow rate in liters per minute and

V=batch volume in liters.

* * * * *